United States Patent [19]

Szadkowski

[11] Patent Number: 4,669,528

[45] Date of Patent: Jun. 2, 1987

[54] DEVICE FOR INTRODUCING AND EXCHANGING A CASTING TUBE

[75] Inventor: Stanislav Szadkowski, Brussels, Belgium

[73] Assignee: International Industrial Engineering SPRL, Brussels, Belgium

[21] Appl. No.: 821,191

[22] Filed: Jan. 22, 1986

[30] Foreign Application Priority Data

Jan. 24, 1985 [BE] Belgium ..... 0/214.385
Dec. 13, 1985 [EP] European Pat. Off. ..... 85870180.8

[51] Int. Cl.[4] ..... B22D 11/10

[52] U.S. Cl. ..... 164/437; 164/337; 222/594

[58] Field of Search ..... 164/437, 337; 222/594

[56] References Cited

U.S. PATENT DOCUMENTS

| | | | |
|---|---|---|---|
| 3,578,062 | 5/1971 | Soeda | 164/437 |
| 3,727,805 | 4/1973 | Shapland | 164/337 |
| 3,730,401 | 5/1973 | Bode, Jr. | 164/337 |
| 3,743,007 | 7/1973 | Simons et al. | 164/337 |
| 3,749,387 | 7/1973 | Andrzejak et al. | 164/337 |
| 3,907,022 | 9/1975 | Simons et al. | 164/437 |
| 4,091,861 | 5/1978 | Thalman et al. | 164/437 |

*Primary Examiner*—Nicholas P. Godici
*Assistant Examiner*—Samuel M. Heinrich
*Attorney, Agent, or Firm*—Sughrue, Mion, Zinn Macpeak & Seas

[57] ABSTRACT

A device for introducing and exchanging a casting tube in a bottom-pour casting vessel allows a worn tube to be replaced without interrupting the casting operation when a movable plate casting tube assembly is mounted in a sliding manner on guides which are suitable for transmitting upward thrust pressure. If the replacement tube is introduced by pivoting in the well of the ingot mould, the exchange of the tube can be carried out without raising the distributor.

8 Claims, 6 Drawing Figures

DEVICE FOR INTRODUCING AND EXCHANGING A CASTING TUBE

BACKGROUND OF THE INVENTION

The present invention relates to a device for introducing and exchanging a casting or pouring tube with a mounted movable plate or flange for a sealable container for the iron and steel or metallurgy industries, equipped with a base plate of refractory material provided with a casting orifice, for another casting or pouring tube also having an attached plate or flange, for producing blooms and small slabs, notably in continuous casting or pouring distributors.

The majority of sealing devices known to this day, with which casting distributors may be provided do not allow long casting sequences to be carried out because of the necessity to replace one of the sensitive refractories after a relatively short time.

French patent no. 2065592 (SCHLOEMANN AKTIENGESELLSCHAFT) describes a device which allows interchangeable casting tubes to be positioned in the extension of a casting orifice of a metallurgical container.

The casting tubes designed to conduct the molten metal into° a mculd or an ingot mould are wearing parts which are under substantial stress, to such an extent that their service life limits the casting time.

Owing to the erosion in the vicinity of the casting, as well as in the interior of the casting tubes, it proves necessary to replace one of the sensitive refractories after a relatively short time. These exchanges of casting tubes have so far prevented long casting sequences from being carried out.

In order to allow a tube to be changed in a continuous casting installation, British Patent no. 1,563,955 (CONCAST AG) proposes a metallurgical container provided with a sealing device and a casting tube through which the molten metal flows towards an intermediate receiver or towards a mould having only one opening with a small cross-section for introducing the casting tube.

A conveyor comprises guide means allowing the tube to be moved along a substantially horizontal path and pivoted from a substantially horizontal position towards a vertical position in such a manner as to allow positioning in the casting line without having to raise the intermediate distributor.

The positioning of the casting tube is carried out by fitting the outlet of the tube into an insert which consists of an exterior rim of the interior nozzle. This operation demands the complete interruption of the casting jet. The connection thus obtained has the disadvantage of affecting the imperviousness of the casting spout and consequently the quality of the metal. In order to protect the molten metal from oxidation, it has proved essential to have a device which provides an inert atmosphere in the vicinity of the casting orifice, for example using argon.

A stopper of refractory material for metallurgical containers designed for continuous casting is known from French patent No. 1,478,778. It comprises a movable refractory plate which can slide, under the action of a screw jack, along an upper fixed plate to a position closing the casting orifice. Levers are provided on which springs act at one end to press the movable plate against the upper plate in an impervious contact. Such a device allows the movable refractory plate of a sliding closing device to be easily replaced but does not allow the casting tube to be replaced without raising the distributor.

Numerous other mechanical devices have been developed to replace casting tubes mounted on the outlet orifice of a casting chamber. Among others, the applicant himself, by French Patent Application no. 2,424,085, has protected a device designed for the replacement, under a distributor, of casting tubes of refractory material. The tubes are charged or loaded transversely in an upright position on intermediate devices consisting, for example, of support slides brought into a casting position by sliding along a substantially horizontal straight path perpendicular to the casting axis.

The casting tubes are applied tightly against the distributor by a lever arm hinged on a common slide. Each lever is provided at its free end with a roller guided by a rail which is pushed downwards by a spring resting against the casting chamber.

In these known devices the juxtaposition of two consecutive tubes is impossible. Due to the construction of the support slide, there inevitably exists a gap between the plates of the tubes and this does not allow the tube to be changed without interrupting casting, Similarly, in order to discharge or remove a tube from the intermediate device and load or insert another tube, the plunging end of which tube is introduced into the continuous casting mould, the distributor must be irremediably raised in order to carry out the transverse loading operation.

BRIEF SUMMARY OF THE INVENTION

The object of the present invention is to exchange casting tubes without having to interrupt casting by raising the intermediate distributor.

The invention proposes the easy replacement of the casting tubes to be allowed independently on each line, in such a manner as to ensure uninterrupted casting over a long period.

It relates to a device for introducing and exchanging a casting tube with a mounted movable plate for a sealable container for the iron and steel or metallurgy industries, equipped with a base plate of refractory material provided with a casting orifice, for another casting tube with an attached movable plate, wherein the movable plates can be joined together by a perfectly smooth common transverse edge in such a manner as to form a perfectly plane surface.

According to one characteristic of the invention, guides are mounted at the end of levers designed to transmit the pressure provided by a spring acting on the opposite end with a view to obtaining an air impervious contact between a reference plate and the movable plate-casting tube assembly.

The reference plate and the mounted movable plate designed to slide along a rectiliner path on the reference plate, advantageously form an inclined plate determined by the above-mentioned path constituting the straight line with the greatest slope.

In a particular embodiment, hydraulic screw jacks ensuring the straight movement of the movable plates attached to the tubes and/or the sealing plates are arranged parallel to the path of the plates behind the guide rails.

Other characteristics and details of the invention will emerge from the following detailed description referring to the attached drawings which illustrate one embodiment of the invention given by way of a non-limiting example.

DETAILED DESCRIPTION

Figure 1:
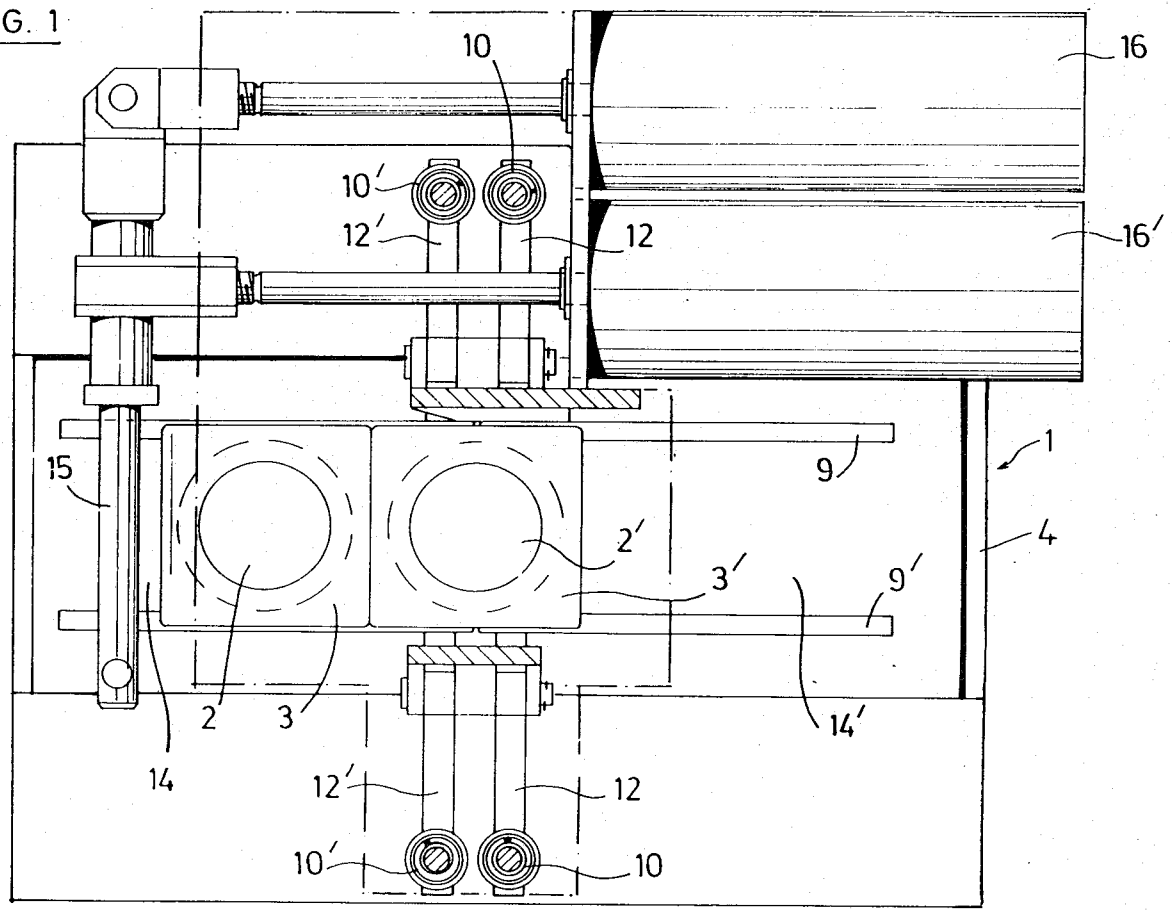
FIG. 1 shows a plan of a device for charging a casting tube according to the invention.

In these Figures, identical reference numerals refer to identical or analogeous elements.

FIGS. 1 to 4 show a device for introducing and charging referred to in its entirety by the reference numeral 1, a reserve casting tube 2 attached to a movable plate (flange or rim) 3, replacing a worn tube 2' attached to a movable plate (flange or rim ) 3', in an operable position, and a main framework 4 designed to be mounted under a casting distributor 5 in the vicinity of a casting orifice 7.

The distributor may optionally be already provided with a sliding seal. The seal does not constitute an obstacle to the direct fixing of the device 1 according to the invention. In a continuous casting installation shown in FIG. 3, the seal is simply a stopper rod 7'.

As illustrated in FIGS. 1 to 4, the casting tubes 2,2', each attached to a movable plate 3,3', slide along a lower plate of the sliding sealing device.

In this case the reference plate 6 along which the introducing and charging device 1 slides is a base plate of the distributor 5 or of the pouring ladle. The movable plate 3,3' attached to the casting tube 2,2' thus serves to ensure imperviousness between the lower nozzle 8 and the reference plate 6 applied against the nozzle seating block 8' and the imperviousness collar.

The reference plate 6 is optionally made up of several independent refractory elements.

Two guides rails 9, 9' have an inclined alignment in relation to the reference plate 6, in such a manner as to approach the casting orifice 7 and allow progressive tightening of the movable plate 3 of a casting tube 2 against the reference plate 6 to be achieved.

Figure 2:
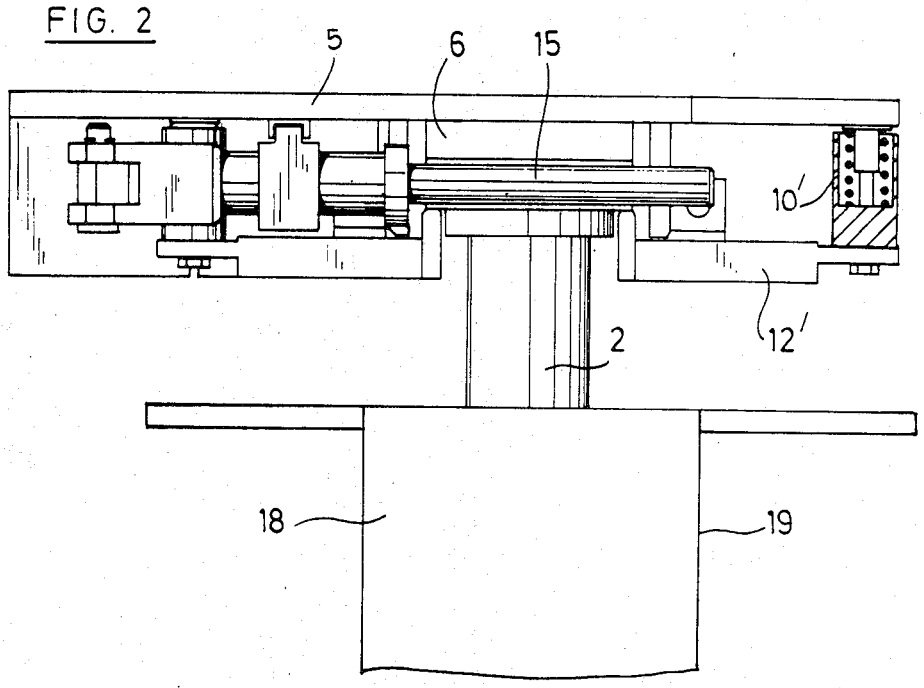
FIG. 2 is a view in lateral elevation of the device shown in FIG. 1.

The upward thrust is obtained by springs 10, 10', mounted at a reasonable distance from the casting orifice 7. As shown in FIGS. 1 and 2, each of the guide rails 9,9' is mounted at first ends of levers 12, 12' which are subjected at their opposite ends to the action of springs 10, 10' withdraw the levers from the chamber 11 of the container 5. The pressure exerted by the guide rails 9,9' on each of the movable plates joined to a casting tube 2 moving along the said supported rails 9,9', increases as these rails approach the casting orifice 7. This upward thrust applies, in a sealed manner, the movable plates 3,3' of the worn casting tube 2' and respectively of the reserve tube 2 against the sliding plane of the reference plate 6.

The inclination of the guide rails 9,9' ensures that the pressure increases when one of the casting tubes 2,2' approaches the casting orifice and decreases when it withdraws therefrom, allowing an easy withdrawal of the above-mentioned plate to a waiting position 14 far away from the casting hole 7.

The straight movement of the movable plates 3,3' is ensured by a pushing arm 15 driven by a a pair of hydraulic screw jacks 16,16' arranged parallel to each other, so as to provide the necessary force for allowing rapid charging or loading of the casting tubes using, to the best possible advantage, the small space available above.

The reserve casting tube 2 pushes the casting tube 2' which is in service.

The device 1 according to the invention allows a casting tube 2' to be replaced in a continuous casting installation without interrupting the casting jet in any noticeable manner.

When during a casting operation it is noticed that the plunging tube 2' is worn or defective, it is ensured that a replacement tube 2 is placed on the guiding path determined by the guide rails 9,9'.

By translation along the guiding path, the worn tube 2' is loosened and removed from the casting zone to a waiting position 14 and the reserve tube 2 is simultaneously introduced under the casting spout.

The linear movement of the two casting tubes 2,2' can likewise be carried out by means of a device of the threaded-nut-rod type.

The assembly of the casting tube consists of a plane connection with the property of having excellent imperviousness and capable of being easily made inert.

Figure 3:
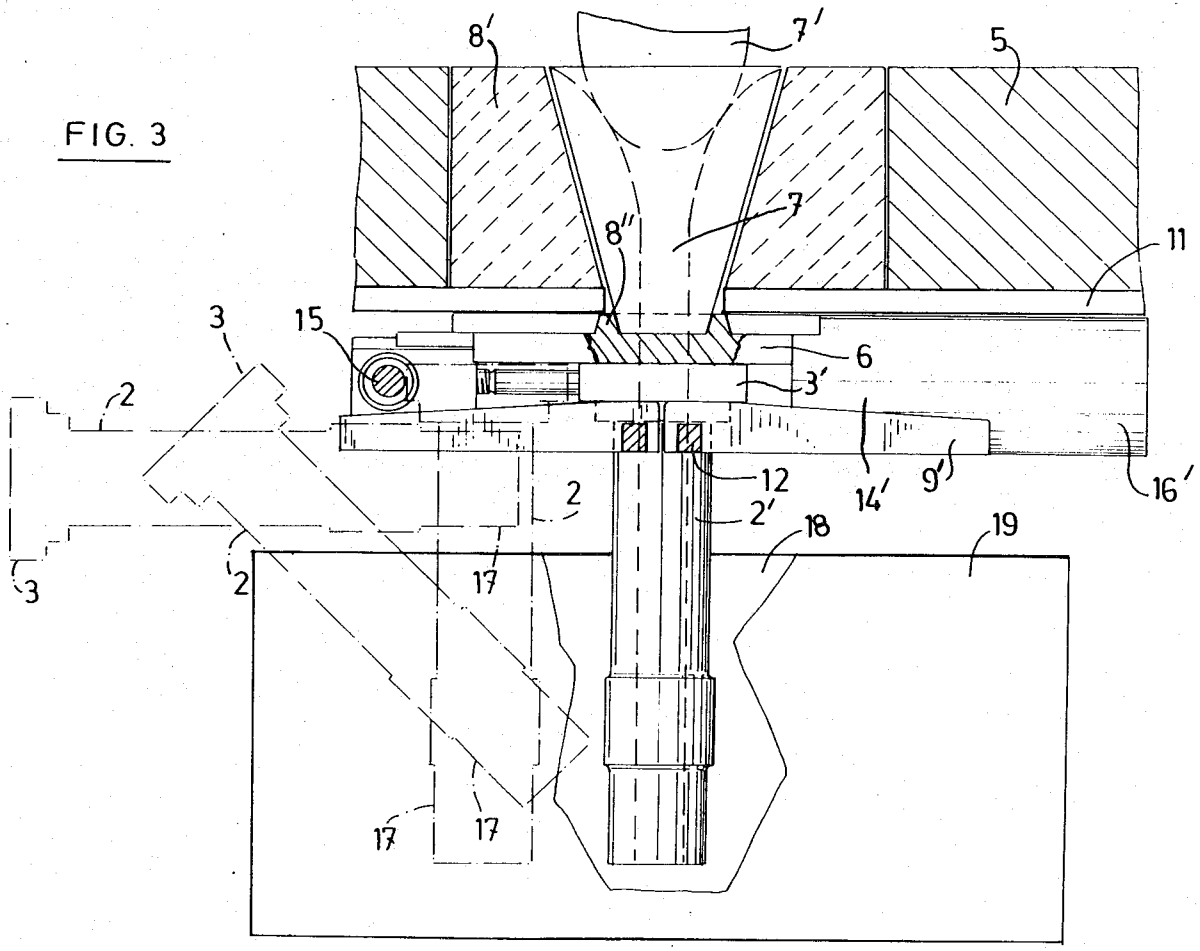
FIG. 3 is a view of a partially exposed end of the device shown in FIGS. 1 and 2.
Figure 4:
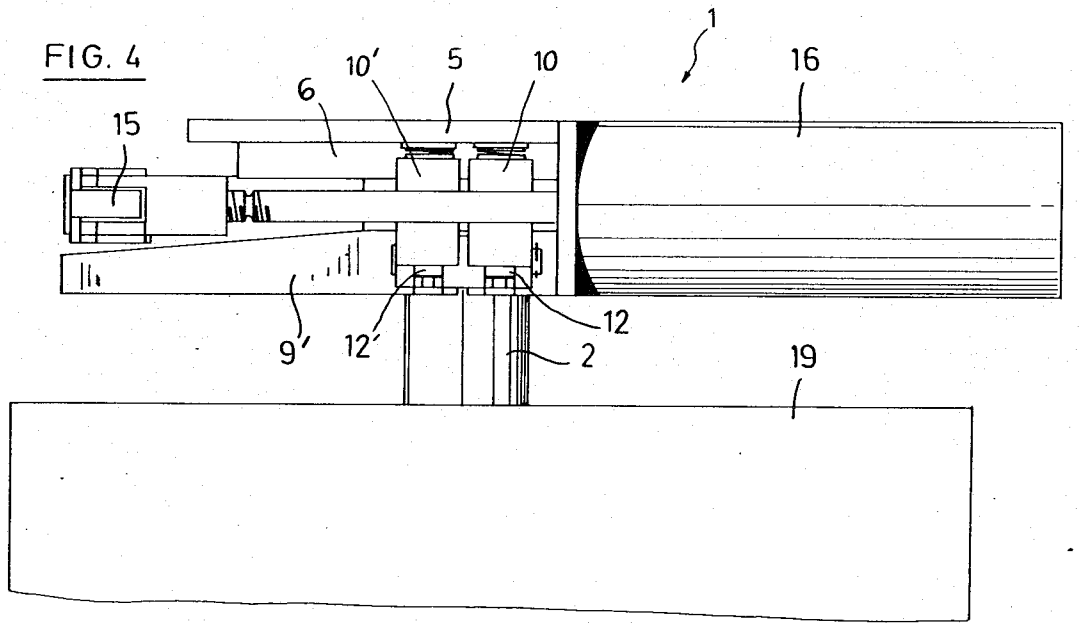
FIG. 4 illustrates the rear face of the device shown in FIGS. 1 and 2.

As illustrated in FIG. 3, the introducing device is a conveyor which allows the reserve tube 2 to run horizontally. The plunging end 17 is introduced into a well 18 of an ingot mould 19 making the casting tube pivot about a substantially horizontal axis. When the tube is arranged vertically, it is slid transversely along the opening of the well of the ingot mould by means of two screw jacks 16,16' shown in FIG. 4, in such a manner as to align the mouth of the casting tube on the casting orifice. The rails 9,9', under the action of the levers 12,12', urged by the springs 10, 10', press the movable plate 3 on the casting tube 2 against the reference plate 6.

In a particular embodiment of a continuous casting installation for small slabs, the reference plate 6 is arranged obliquely in such a manner that its inclination follows the path of introduction of the tubes from their waiting position to a continuous casting position.

Figure 5:
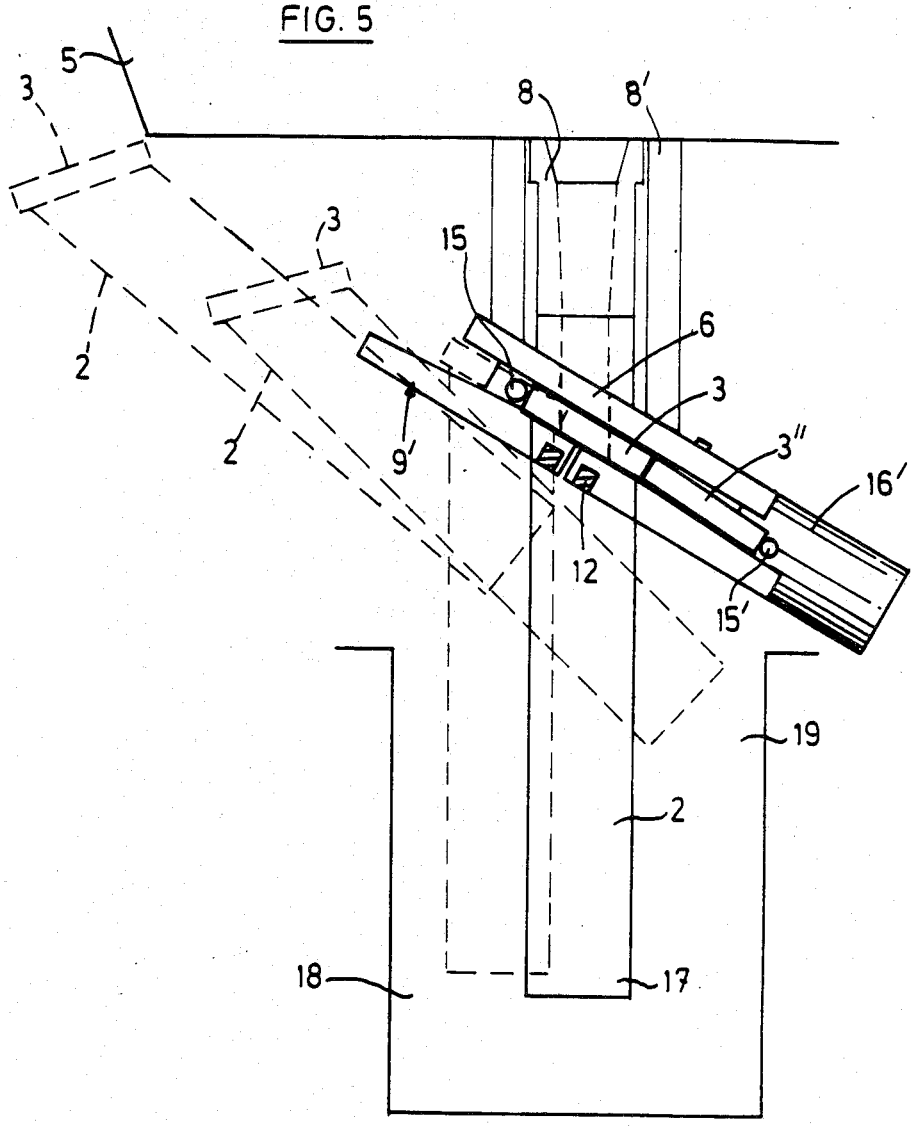
FIG. 5 is a view in vertical section of a device adapted to an oblique reference plate.

When a mould with a small cross-section is being dealt with, for example for small slabs as illustrated in FIG. 5, it is difficult to introduce the plunging end 17 of the tube 2 into the mould 19 and to swing the tube 2 without damaging the tube or the walls of the mould 19, especially when the distance between the reference plate 6 and the mould 19 is restricted. The narrowness of the mould 19 actually prevents the tube 2 from being driven in at too much of an angle.

An inclined arrangement of the reference plate 6 aims to facilitate the introduction of the plunging end 17 of the tube because it allows the tube to occupy a higher position than if the plate 6 were arranged horizontally.

This tube 2 is thus less inclined than if it had been introduced in a conventional introducing and exchange device comprising a horizontal reference plate 6.

As the tube 2,2' is slid into the mould 19, it erects itself and allows its attached plate 3,3' to be applied in an impervious manner on the reference plate 6. This reasoning also applied to the withdrawal of the tube 2 which swings progressively while it is raised.

It is thus possible to change the casting tube without raising the distributors again.

An inclined arrangement of the reference plate 6 likewise allows the distance between the base of the distributor and the mould to be reduced without encroaching on the plunging height of the tube.

The particular position of the thrust screw jacks 16,16' arranged laterally away from the introduction path of the casting tubes 2,2', actually allows the tubes 2,2' to be charged (inserted or loaded) and/or discharged (removed or unloaded) by making them swing in a vertical plane passing via the introduction path of the tube 2,2' in a casting position, whereas previously the charging and discharging operations had to be carried out in a transverse direction, which is more inconvenient when the distributor comprises several parallel casting lines.

Figure 6:
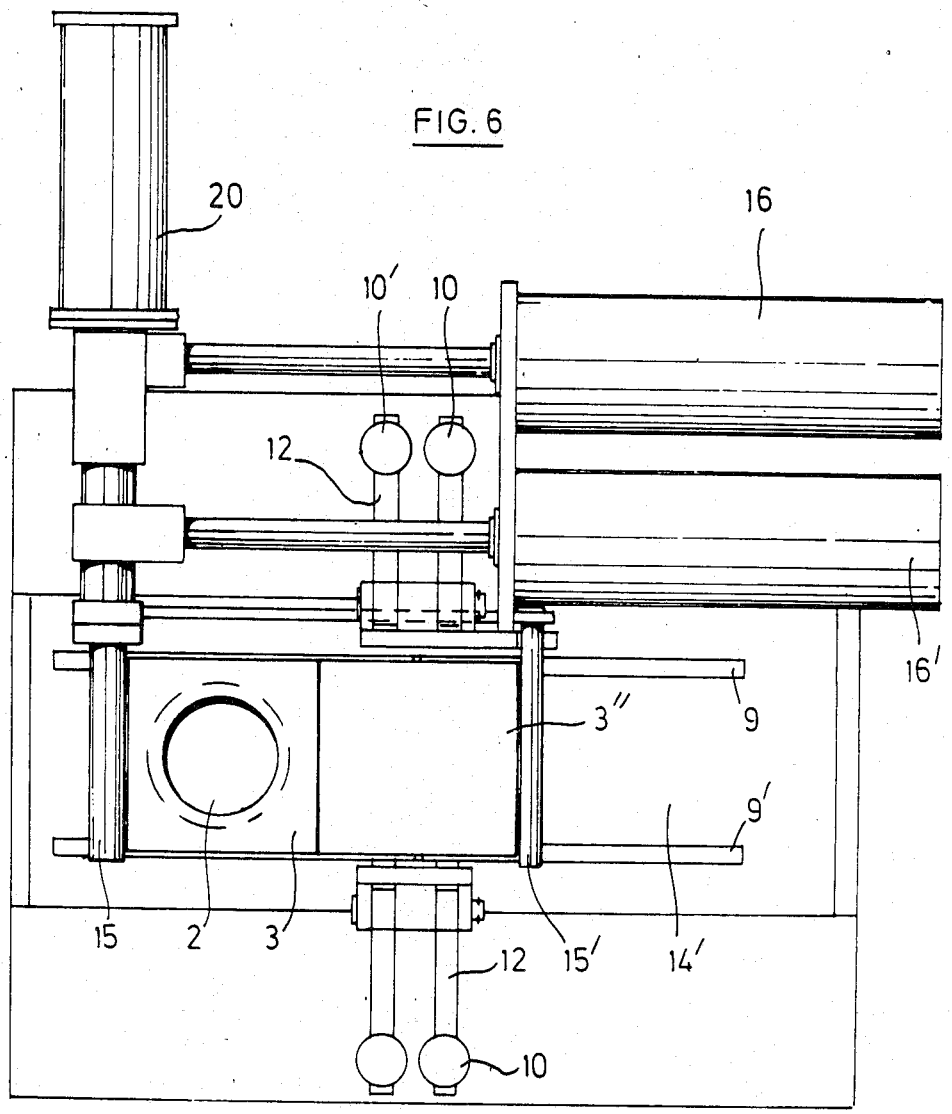
FIG. 6 illustrates the charging of a casting tube in a device provided with a screw jack controlling the withdrawal of a pushing arm.

In the particular case of an inclined arrangement shown in FIG. 6, the procedure of positioning and replacing a worn tube is carried out in the following manner.

It is arranged in the first place that a sealing plate 3'' is positioned on the introducing and charging device and that it is brought opposite the casting orifice 7 by being slid along the guide rails 9,9'. As the sealing plate is brought towards the casting orifice 7 under the action of the pushing arm 15, the levers 12 and the springs 10 push the plate upwards and apply it in an impervious manner against the reference plate 6.

When the sealing plate 3'' is in position, the hydraulic screw jacks 16,16' are again extended and the pushing arm is withdrawn laterally by an auxiliary screw jack 20. The introducing and charging device 1 is thus accessible to a casting tube which is introduced into a free space at the end of the guide rails 9,9' by swinging the casting tube over itself. When the tube has been charged or loaded on the guide rails, the pushing arm 15 is brought into action and the attached plate 3 of the tube 2 is brought into a waiting position 14 against the sealing plate by means of the pushing arm 15 under the action of the screw jack 16,16'.

The casting operation is set into action as soon as the casting tube is moved towards the casting orifice. Under the thrust of the pushing arm 15, an edge of the attached plate 3 of the tube 2 is applied in an air-impervious manner against the juxtaposed edge of the sealing plate 3''. The attached plate 3 forms a smooth surface with the sealing plate 3'' applied in an impervious manner against the reference plate 6. It is thus sufficient to position the casting tube by sliding under the thrust of the screw jacks 16,16'.

When it is noticed during the casting operation that the casting tube 2 which has become 2' is worn or defective and that it must be replaced, the casting is ceased momentarily by means of the sealing plate 3'', which has up until now been kept in a waiting position 14' on the guide rails 9,9'.

The introduction of the sealing plate 3'' is carried out by the thrust of a second pushing arm 15' rigidly fixed to the rods of the double-action hydraulic screw jacks 16,16'. The worn tube is withdrawn towards the waiting position 14 under the thrust of the sealing plate 3''.

Owing to the constructive form of the rails 9,9', the worn tube 2' is loosened and can be easily withdrawn from the introducing device and be replaced by another tube since the pushing arm 15 is retractable.

Once the new casting tube 2 is introduced into the introducing and charging device 1, it can be quickly positioned under the casting spout.

The total duration of the replacement operation of a worn tube 2' by another tube is thus very short. It does not exceed about 10 seconds for experienced operators. Furthermore, it can take place without being disturbed by other casting lines connected to the same distributor, since it is carried out in a longitudinal direction, in the extension of the path determined by the rails 9,9'.

Evidently, the invention is not limited to the embodiments described above and numerous modifications can be made to these embodiments without removing them from the scope of the invention, as long as they fall within the scope of the following claims.

What we claim is:

1. A device for introducing and exchanging casting tubes beneath the casting orifice of a sealable bottom-pour casting vessel having a bottom wall including a base plate of refractory material provided with said casting orifice, the upper end of each casting tube having an attached flange, said device comprising: guide rail means for simultaneously supporting at least two casting tubes for sliding movement, said guide rail means being disposed beneath said orifice and extending therefrom in both directions along a linear path parallel to said base plate, said guide rail means having inclined tube-supporting surfaces which slope upwardly toward said orifice along said path on both sides of said pouring axis, said guide rail means functioning to support a first casting tube, in a casting position in vertical alignment with said orifice and in an air-impervious sealing engagement with said base plate, and a second casting tube in a waiting position horizontally adjacent said casting position; and pushing means for pushing said second casting tube toward said pouring axis and along an inclined surface so that the flanges of both tubes abut to form an air-impervious plane surface, and so that said second tube pushes said first tube away from said casting position and, itself, occupies said casting position.

2. A device according to claim 1, wherein said guide rail means and said base plate are horizontal and said linear path is perpendicular to said pouring axis.

3. A device according to claim 8, further comprising: lever means, engaging the horizontally opposite ends of said guide rail means which are adjacent said pouring axis, for forcing said guide means upwardly into engagement with said base plate; and spring means for urging said guide rail means upwardly.

4. A device according to claim 1, wherein said flange is a blank plate.

5. A device according to claim 2, wherein said pushing means comprises hydraulic cylinders which extend in a direction parallel to said linear path and which are located behind said guide rail means in a direction perpendicular to said linear path.

6. A device according to claim 5, wherein said pushing means comprises a pushing arm coupled to said hydraulic cylinders and extending into and across said linear path in a direction perpendicular thereto for engaging said second casting tube, and means for retracting said pushing arm from said path.

7. A device according to claim 1, wherein said base plate is inclined to the horizontal in such a manner that its inclination follows the path of movement of the tubes from said waiting position to the said casting position.

8. A device according to claim 6, wherein the flange attached to each casting tube is inclined at an angle which matches the angle of inclination of said base plate.

* * * * *